US007349650B2

(12) United States Patent
Sunohara

(10) Patent No.: US 7,349,650 B2
(45) Date of Patent: Mar. 25, 2008

(54) PRINTER APPARATUS

(75) Inventor: Takahiro Sunohara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 225 days.

(21) Appl. No.: 11/248,205

(22) Filed: Oct. 13, 2005

(65) Prior Publication Data

US 2006/0083543 A1 Apr. 20, 2006

(30) Foreign Application Priority Data

Oct. 14, 2004 (JP) ..... 2004-300262

(51) Int. Cl.
*G03G 15/00* (2006.01)
*G03G 15/01* (2006.01)

(52) U.S. Cl. ..... 399/124; 399/302; 399/303

(58) Field of Classification Search ..... 399/124, 399/111, 112, 302, 303
See application file for complete search history.

(56) References Cited

U.S. PATENT DOCUMENTS 6,157,799 A * 12/2000 Asakura et al. ..... 399/302
6,185,396 B1 * 2/2001 Aizawa et al. ..... 399/302
7,203,447 B2 * 4/2007 Koshida ..... 399/124

FOREIGN PATENT DOCUMENTS

JP 10-187002 7/1998
JP 2004206071 A * 7/2004

* cited by examiner

*Primary Examiner*—Susan Lee
(74) *Attorney, Agent, or Firm*—Rabin & Berdo, PC

(57) ABSTRACT

An image forming apparatus includes an image forming portion disposed in a detachable manner, an opening and closing member taking a closed position and an open position, a transfer unit disposed at the opening and closing member, as facing the image forming portion, having a belt disposed in a freely drivable manner and transferring a developer image, and a medium conveyance member for forming a conveyance route conveying a medium and for opening the conveyance route in association with movement of the opening and closing member from the closed position to the open position.

14 Claims, 13 Drawing Sheets

PRINTER APPARATUS

BACKGROUND OF THE INVENTION

1. Field of the Invention

This invention relates to an image forming apparatus.

2. Description of Related Art

A conventional image forming apparatus such as, e.g., a printer, a photocopier, a facsimile machine, or the like, for example, a multicolor printer, makes printing operation in which a toner image is formed with an image forming unit based on image data and is transferred onto a conveyed paper, and in which the paper on which the toner image is transferred is conveyed up to a fuser to fuse the toner image onto the paper at the fuser.

Upon occurrence of trouble in paper conveyance, i.e., occurrence of paper jamming, with the printer of this type, an upper cover disposed on an upper surface of the printer is made open to detach the image forming unit from an apparatus body, and a side door disposed at a side surface of the apparatus housing is made open to remove the jammed paper. In a printer having a plurality of image forming units, when a belt for conveying the paper is replaced, the upper cover is also made open to detach all of the image forming units from the apparatus body, and the side door is made open to replace the belt (see, e.g., Japanese Patent Application Publication No. H10-187,002.)

It is necessary with the above conventional printer, however, to open the upper cover and the side door to remove the jammed paper or to exchange the belt, so that not only does the operation require laborious work but also possible installation locations of the printer are limited.

This invention is to solve the above problems in the conventional printer and to provide an image forming apparatus not only to enable an operator to simplify the operation for removing a jammed medium and for exchanging the belt but also to allow the printer to be installed further unrestrictedly.

SUMMARY OF THE INVENTION

To solve the above problems, an image forming apparatus according to this invention comprises an image forming portion disposed in a detachable manner, an opening and closing member taking a closed position and an open position, a transfer unit disposed at the opening and closing member, as facing the image forming portion, having a belt disposed in a freely drivable manner, and transferring a developer image, and a medium conveyance member for forming a conveyance route conveying a medium and for opening the conveyance route in association with movement of the opening and closing member from the closed position to the open position.

The image forming apparatus according to this invention includes the image forming portion disposed in a detachable manner, the opening and closing member taking the closed position and the open position, the transfer unit disposed at the opening and closing member, as facing the image forming portion, having the belt disposed in a freely drivable manner and transferring the developer image, and the medium conveyance member for forming the conveyance route conveying the medium and for opening the conveyance route in association with the movement of the opening and closing member from the closed position to the open position.

In this case, the transfer unit and the image forming unit are separated from each other upon placing the opening and closing member at the opening position thereby being able to replace the image forming unit, the belt, or the like, and furthermore the conveyance route is made open in association with the opening and closing member, thereby being able to remove easily the medium which is jammed in the conveyance route.

Furthermore, not only can the operation be simplified but also the installation locations can be made further unrestrictedly since the image forming unit, the belt, or the like can be replaced and the jammed medium can be removed from the side formed with the opening and closing member, i.e., a single side surface of the image forming apparatus.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DETAILED DESCRIPTION OF THE PREFERRED EMBODIMENTS OF THE INVENTION

Hereinafter, embodiments of this invention will be described in detail in reference to drawings. In this case, a multicolor printer defined as an image forming apparatus is described.

Figure 1:
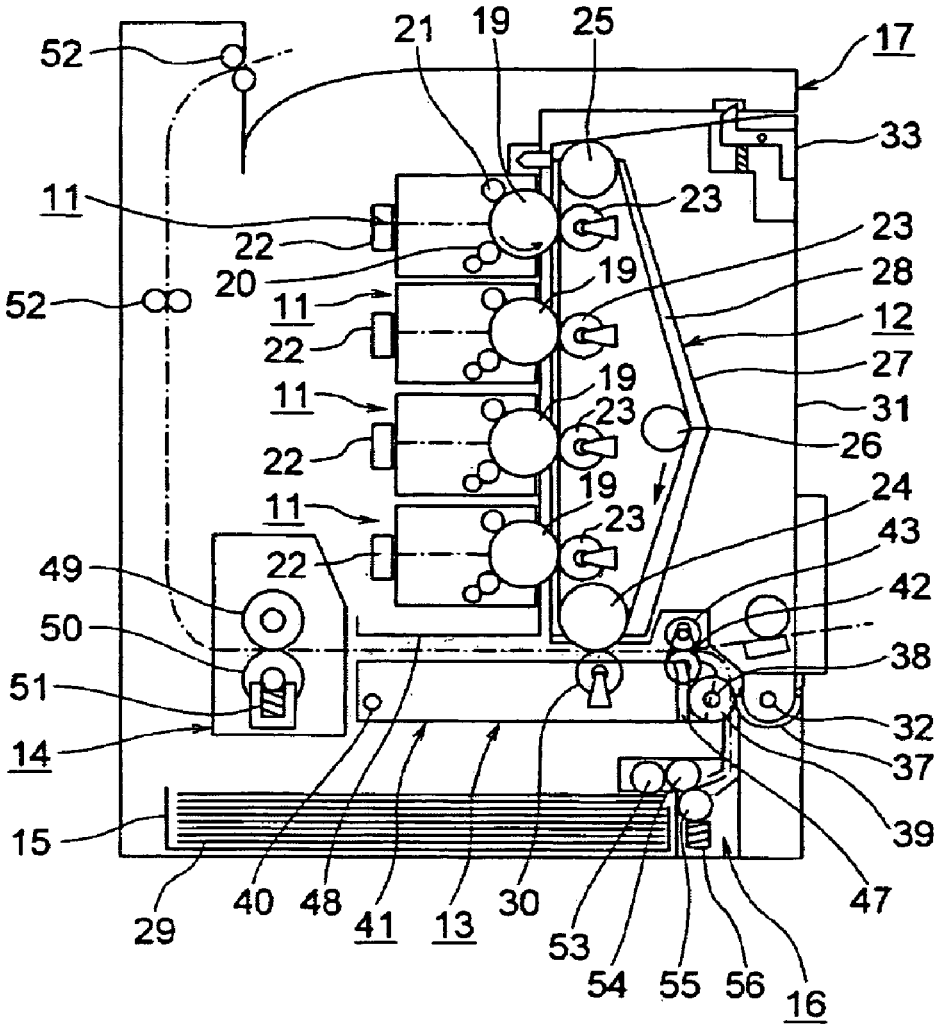
FIG. 1 is a schematic view showing the first status of a printer according to a first embodiment of this invention.
Figure 2:
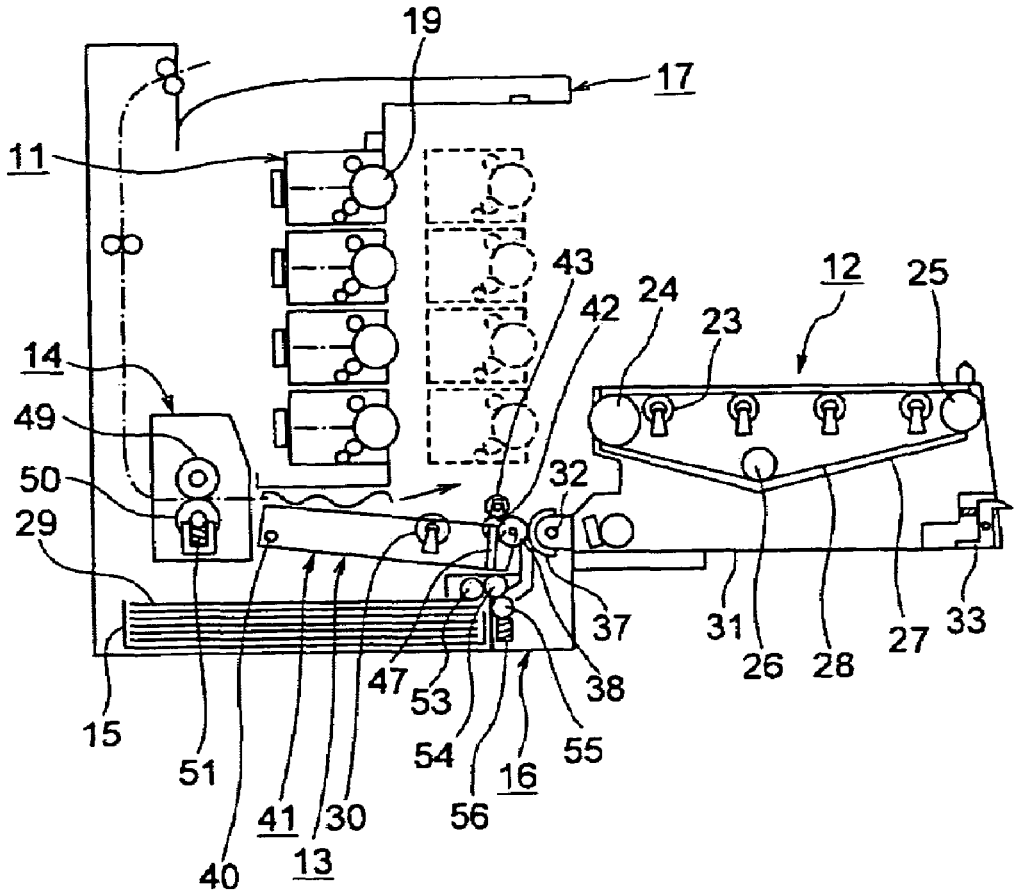
FIG. 2 is a schematic view showing the second status of the printer according to the first embodiment of this invention.
Figure 3:
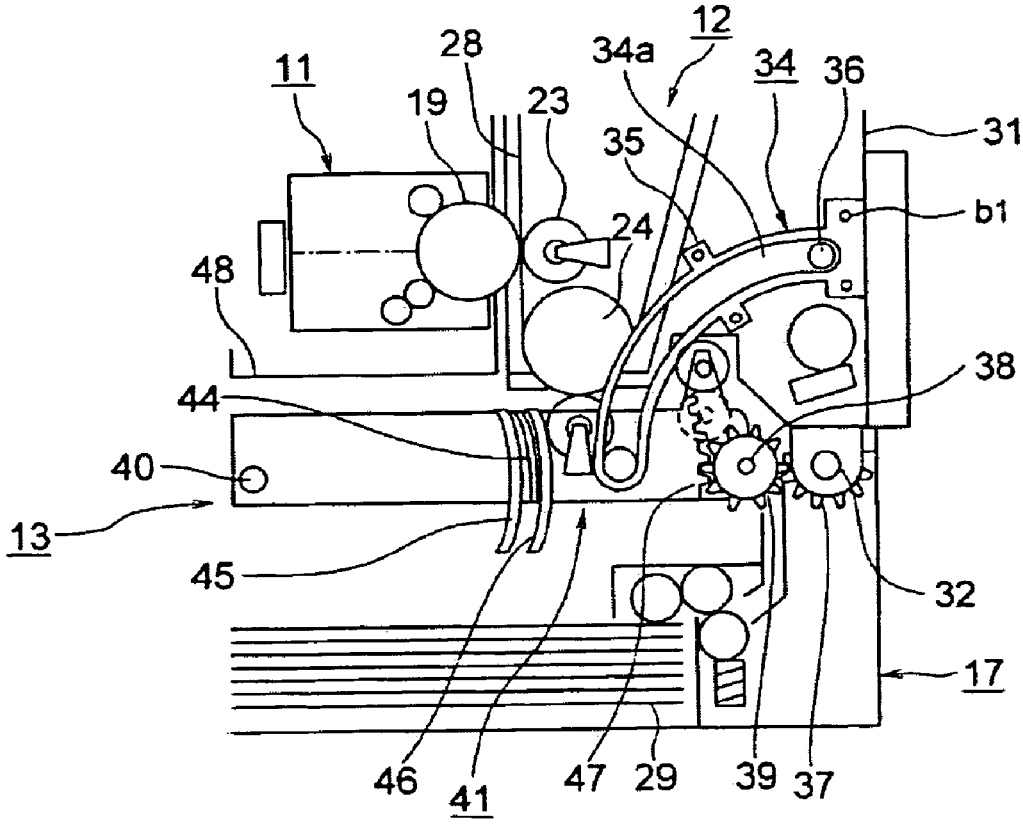
FIG. 3 is an enlarged view showing the first status of an essential part of the printer according to the first embodiment of this invention.
Figure 4:
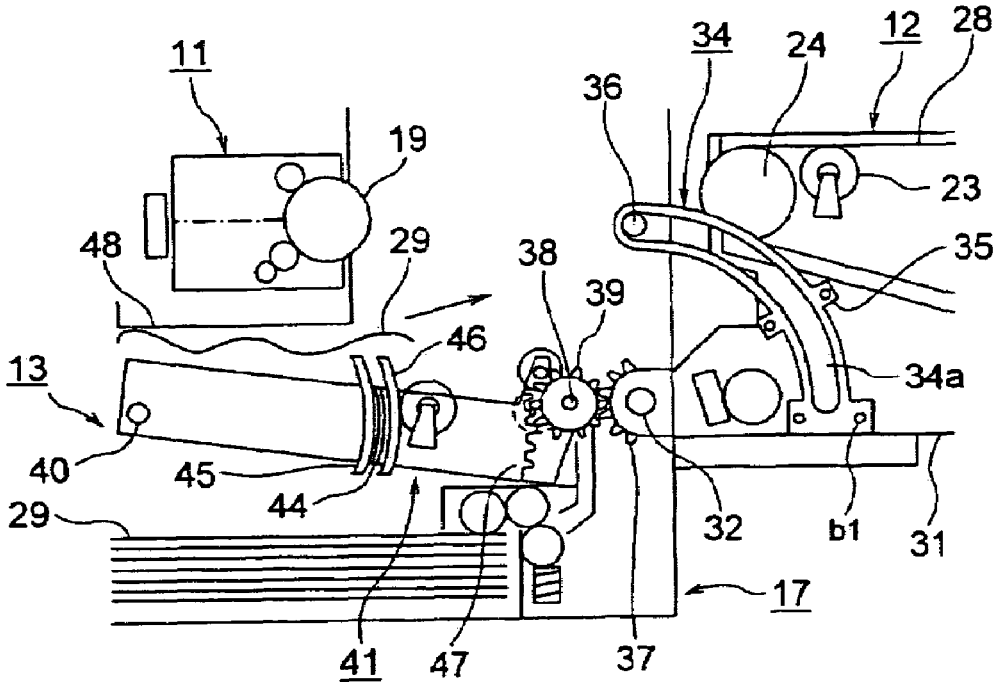
FIG. 4 is an enlarged view showing the second status of the essential part of the printer according to the first embodiment of this invention.
Figure 5:
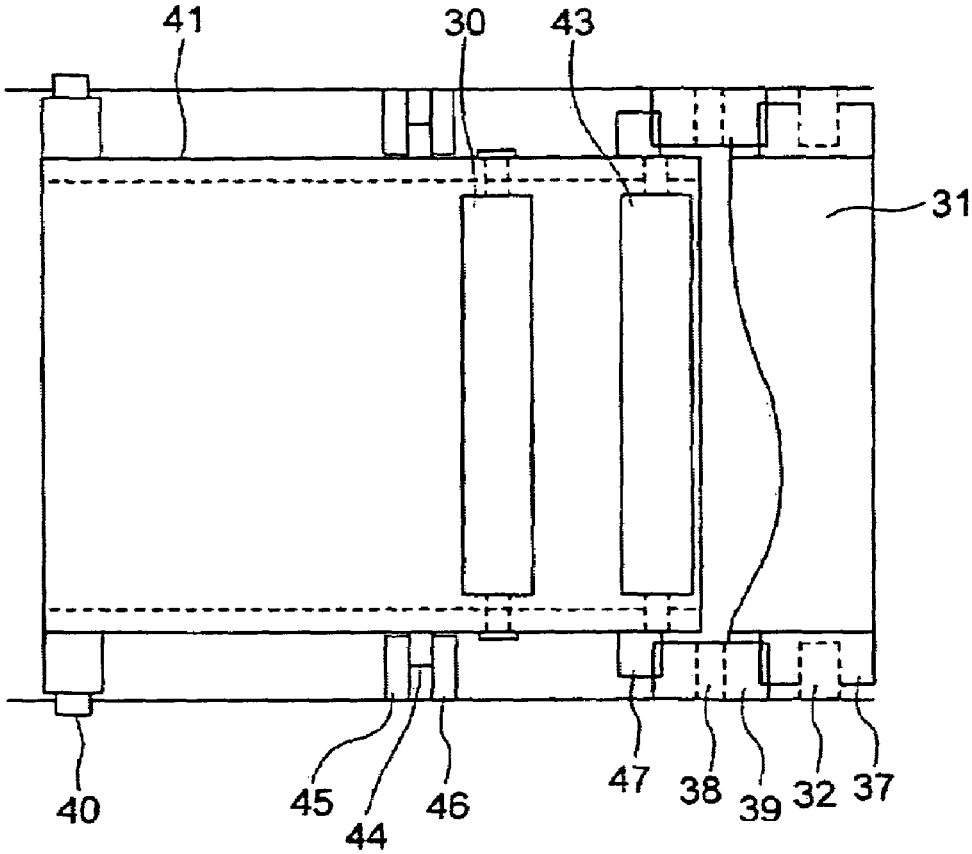
FIG. 5 is a plain view showing the second status of the essential part of the printer according to the first embodiment of this invention.

FIG. 1 is a schematic view showing the first status of a printer according to a first embodiment of this invention. FIG. 2 is the schematic view showing a second status of the printer according to the first embodiment of this invention. FIG. 3 is an enlarged view showing the first status of an essential part of the printer according to the first embodiment of this invention. FIG. 4 is an enlarged view showing the second status of the essential part of the printer according to the first embodiment of this invention. FIG. 5 is a plain view showing the second status of the essential part of the printer according to the first embodiment of this invention.

As shown in drawings, the printer forms, by an electrophotographic system, images based on image data transmitted from such as e.g., a computer defined as an exterior host apparatus on a paper 29 serving as a medium as well as a transfer member. The printer is composed of image forming units 11 composed of four image drum cartridges, a transfer unit 12 disposed as facing the image forming units 11, a medium conveyance unit 13, a fusing unit 14, a feeding tray 15 serving as a medium container, a feeding conveyance unit 16 serving as a medium supplying unit, optical units 22 serving as an exposure device disposed as facing each of the image forming units 11, and a housing 17 containing these units.

Each of the image forming units 11 is disposed in a detachable manner and holds a photosensitive drum 19 serving as an image carrier, a developing device 20, a charging device 21, and the like.

The optical unit 22 is defined as an LED head in which LED elements defined as a driver element are arrayed in an axial direction to the photosensitive drum 19. In the meanwhile, instead of the optical unit 22, a laser scanning unit having a laser irradiating unit and a polygon mirror can be used as the exposure device.

The transfer unit 12 has four primary transfer rollers 23 serving as a first transfer roller arrayed in a line from an upper side to a lower side in drawings, as facing each of the photosensitive drums 19 at the image forming unit 11, a belt driving roller 24 serving as a first conveyance roller, a driving auxiliary roller 25 serving as a second conveyance roller, a tension adding roller 26, a belt serving as an intermediate transfer member disposed in a freely drivable manner, i.e., an intermediate transfer belt 28, and a transfer frame 27.

The intermediate belt 28 is defined as an endless belt sandwiched between each of the primary transfer rollers 23 and each of the photosensitive drums 19 and formed as tensioned among the primary transfer roller 23, the belt driving roller 24, the driving auxiliary roller 25, and the tension adding roller 26. The toner image defined as the developer image in each color formed on each of the photosensitive drums 19 is transferred sequentially onto the intermediate transfer belt 28 to form the toner image in multicolor where a bias voltage is applied to the primary transfer roller 23. The belt driving roller 24 is rotated upon driving a conveyance motor defined as a driving portion, not shown, so that the intermediate transfer belt 28 is driven in a certain direction (an arrow direction in drawings) in accordance with the rotation of the belt driving roller 24.

At the medium conveyance unit 13, a conveyance frame 41 serving as a medium conveyance member is disposed in a pivotal manner with a shaft 40 as the center. Thus, a guide 44 disposed at the conveyance frame 41 is sandwiched between guides 45, 46 formed at the housing 17. On the conveyance frame 41, a pair of conveyance rollers 42, 43 is rotatably disposed as facing each other whereas a secondary transfer roller 30 serving as a second transfer member is rotatably disposed as facing the belt driving roller 24 and a nipping unit allowing the intermediate transfer belt 28 and the paper 29 to be passed therethrough is formed between the belt driving roller 24 and the secondary transfer roller 30. The multicolored toner image formed on the intermediate transfer belt 28 is transferred onto the paper 29 upon application of the bias voltage to the secondary transfer roller 30.

Furthermore, an urging member, not shown, urges a shaft of the conveyance roller 43 so the conveyance roller 43 can be pressed to the conveyance roller 42.

A holding frame 31 serving as an opening and closing member is supported in a pivotal manner with a shaft 32 of the housing 17 as a pivotal center and takes an open position and a closed position. Therefore, a coupling lever 34 in an arc shape serving as a coupling member is secured with screws b1, 35 to the holding frame 31, and a post 36 serving as a guided portion disposed at the housing 17 is inserted into an opening portion 34*a* in an arc shape serving as a guiding portion formed in a longitudinal direction of the coupling lever 34. A gear 37 mounted in a non-rotatable manner onto the shaft 32 secured to the holding frame 31 meshes with a gear 39 disposed rotatably at a shaft 38 of the housing 17 as a center.

A lever 33 is disposed in a pivotal manner at the holding frame 31, and the holding frame 31 can be locked in or released from the housing 17 upon operation of the lever 33. The transfer unit 12 is disposed in a detachable manner to the holding frame 31. A gear 47 rotating with the shaft 40 of the conveyance frame 41 as a center meshes with the gear 39. A conveyance guide 48 is disposed in a position facing the conveyance frame 41 and secured to the housing 17.

The fusing unit 14 disposed on a downstream side of the conveyance frame 41 in a paper conveyance direction has a rotatably disposed heat roller 49 serving as a first roller incorporating a heat source, a pressure roller 50 serving as a second roller rotatably disposed facing the heat roller 49, and an urging member 51 for urging the pressure roller 50 to the heat roller 49, and nips the paper 29 to compose a nipping device. A discharging roller 52 is disposed on a further downstream side with respect to the fusing unit 14 in the conveyance direction of the paper 29.

The feeding tray 15 is defined as a tray mounted on a bottom portion of the housing 17 and contains the stacked papers 29. The feeding conveyance unit 16 is disposed at the front end (a right end in drawings) of the feeding tray 15 and has a pick-up roller 53 for picking up sheet by sheet the papers 29 contained in the feeding tray 15, a feeding roller 54 for feeding the picked-up paper 29 to the conveyance roller 42, a separating roller 55 disposed at a position facing the feeding roller 54, incorporating a torque limiter, and an urging member 56 for urging the separating roller 55 to the feeding roller 54. It is to be noted that the feeding roller 54 forms the first roller whereas the separating roller 55 forms the second roller.

Operation of the printer thus structured is described next.

In this case, the printer makes printing operation in a state where the holding frame 31 takes the open position, as shown in FIG. 1.

With each of the image forming units 11, the optical unit 22 forms based on the image data electrostatic latent images on the photosensitive drum 19, and then the developing device 20 develops the electrostatic latent images to form the toner images. With the transfer unit 12, the intermediate transfer belt 28 is driven upon the rotation of the belt driving roller 24 and the toner images on the photosensitive drums 19 are sequentially transferred to the intermediate transfer belt 28 with the primary transfer roller 23 to which the bias voltage is applied, thereby forming the toner images in multicolor on the intermediate transfer belt 28.

The pick-up roller 53 in the feeding conveyance unit 16 is rotated to pick up sheet by sheet the papers 19 contained in the feeding tray 15 and the paper 29 is fed to the nipping unit upon the rotation of the feeding roller 54 and the conveyance roller 42. At the nipping unit, the multicolored toner images on the intermediate transfer belt 28 are subsequently transferred onto the paper 29 with the secondary transfer roller 30. The paper 20 onto which the multicolored toner images are transferred is then passed between the conveyance guide 48 and the conveyance frame 41 and subsequently fed to the fusing unit 14 to be pressurized and heated between the heat roller 49 and the pressure roller 50, and in this bout, the multicolored toner images are fused onto the paper 29 to become multicolored images. The paper 29 formed with the multicolored images is discharged with the discharging roller 52 to an exterior of the housing 17.

The operator performs a process for removing the paper 29, i.e., a jamming process where the printing operation is suspended upon occurrence of a conveyance trouble in the conveyed paper 29. Furthermore, in a case of replacing the image forming unit 11, the intermediate transfer belt 28 of the transfer unit 12, and the like, the operator releases a lock between the lever 33 and the housing 17 by swinging pivotally the lever 33 disposed at the holding frame 31 and places the holding frame 31 at the open position by moving pivotally the holding frame 31 in a clockwise direction around the shaft 32 as a center.

Consequently, the intermediate transfer belt 28 of the transfer unit 12 supported with the holding frame 31 is separated from each of the photosensitive drums 19. Furthermore, where the operator moves pivotally the holding frame 31 around the shaft 32 as a center up to a position at which the image forming unit 11 can be replaced, the post 36 is brought in contact with an end portion of the opening portion 34*a* of the coupling lever 34, thereby suspending the pivoting movement operation. Furthermore, since the gear 37 mounted in a non-rotatable manner on the holding frame 31 is rotated in association with the pivotal movement of the holding frame 34, in a clockwise direction around the shaft 32 as a center together with the holding frame 31, the gear 39 in mesh with the gear 37 is rotated in a counterclockwise direction with the shaft 38 as a center.

The medium conveyance unit 13 is pivotally moved in a clockwise direction around the shaft 40 as a center since the gear 47 formed at a front end of the conveyance frame 41, in mesh with the gear 39 is rotated upon rotation of the gear 39, with the shaft 40 as center together with the conveyance frame 41. In this bout, the guide 44 formed at a conveyance frame 41 is guided as nipped between the guides 45, 46 formed at the housing 17.

Therefore, where pivotally moving the holding frame 31 up to a position at which the image-forming unit 11 can be replaced, as described above, the conveyance route between the conveyance frame 41 and the conveyance guide 48 is made open in association with the pivotal movement of the holding frame 31. Consequently, upon pivotal movement of the holding frame 31 up to a position at which the image forming unit 11 can be replaced, not only can the image forming unit 11, the intermediate transfer belt 28 of the transfer unit 12, and the like be replaced, but also the conveyance route between the conveyance frame 41 and the conveyance guide 48 is made open, so that the paper 29 on the conveyance route can be easily removed even in the event of the conveyance trouble on the conveyed paper 29.

The gear 39 in mesh with the gear 37 is rotated in a clockwise direction with the shaft 38 as a center since the gear 37 mounted to the holding frame 31 is rotated in a counterclockwise direction with the shaft 32 as a center where the holding frame 31 is pivotally moved from the open position to the closed position after the operator removes the paper 29 or replaces the image forming unit 11, the intermediate transfer belt 28 of the transfer unit 12, or the like. Furthermore, the medium conveyance unit 13 is pivotally moved around the shaft 40 as a center in a counterclockwise direction since the gear 47 formed to the conveyance frame 41 is rotated with the shaft 40 as a center upon the rotation of the gear 39. As a result, the conveyance route for the paper 29 is formed again between the conveyance frame 41 and the conveyance guide 48.

In this embodiment, as described above, the operator can replace the image forming unit 11, the intermediate transfer belt 28 of the transfer unit 12, or the like since the intermediate transfer belt 28 and each of the photosensitive drums 19 are separated from each other upon pivotal movement of the holding frame 31 up to a position at which the image forming unit 11 can be replaced, and furthermore, the operator can easily remove the paper 29 causing the conveyance trouble in the conveyance route since the conveyance route between the conveyance frame 41 and the conveyance guide 48 can be made open in association with pivotal movement of the holding frame 31.

Furthermore, the gear 47 of the conveyance frame 41 can be rotated in association with rotation of the gear 37 of the holding frame 31 at a time of rotating the holding frame 31, so that the operation for separating the intermediate transfer belt 28 from each photosensitive drum 19 can be made simply in association with the operation for opening the conveyance route between the conveyance frame 41 and the conveyance guide 48.

Not only can the operation be simplified but also the installation location of the printer can be made unrestrictedly since the image forming unit 11, the intermediate transfer belt 28 of the transfer unit 12, and the like can be replaced and the jammed paper 29 can be removed from one side formed with the holding frame 31, i.e., a single side surface of the printer.

In the meanwhile, each of the image forming units 11 is secured to the housing 17 to move pivotally the transfer unit 12 including the intermediate transfer belt 28 in this embodiment but adversely, the transfer unit 12 including the intermediate transfer belt 28 can be secured to the housing 17 to move pivotally the image forming unit 11. Substantially the same effect as described above can be also obtained in this case upon opening the conveyance route between the conveyance frame 41 and the conveyance guide 48 in association with the pivotal movement of the image-forming unit 11.

Described in this embodiment is a printer of a tandem intermediate transfer system but substantially the same effect as that described above can be obtained in using a printer of a cycle intermediate transfer system.

The second embodiment will be described next. It is to be noted that substantially the same structures as those in the first embodiment are assigned with the same reference number as in the first embodiment, and for the sake of simplicity, those duplicated descriptions are omitted. Furthermore, the effect of the invention resulted from substantially the same structures is quoted from the effect in the first embodiment.

Figure 6:
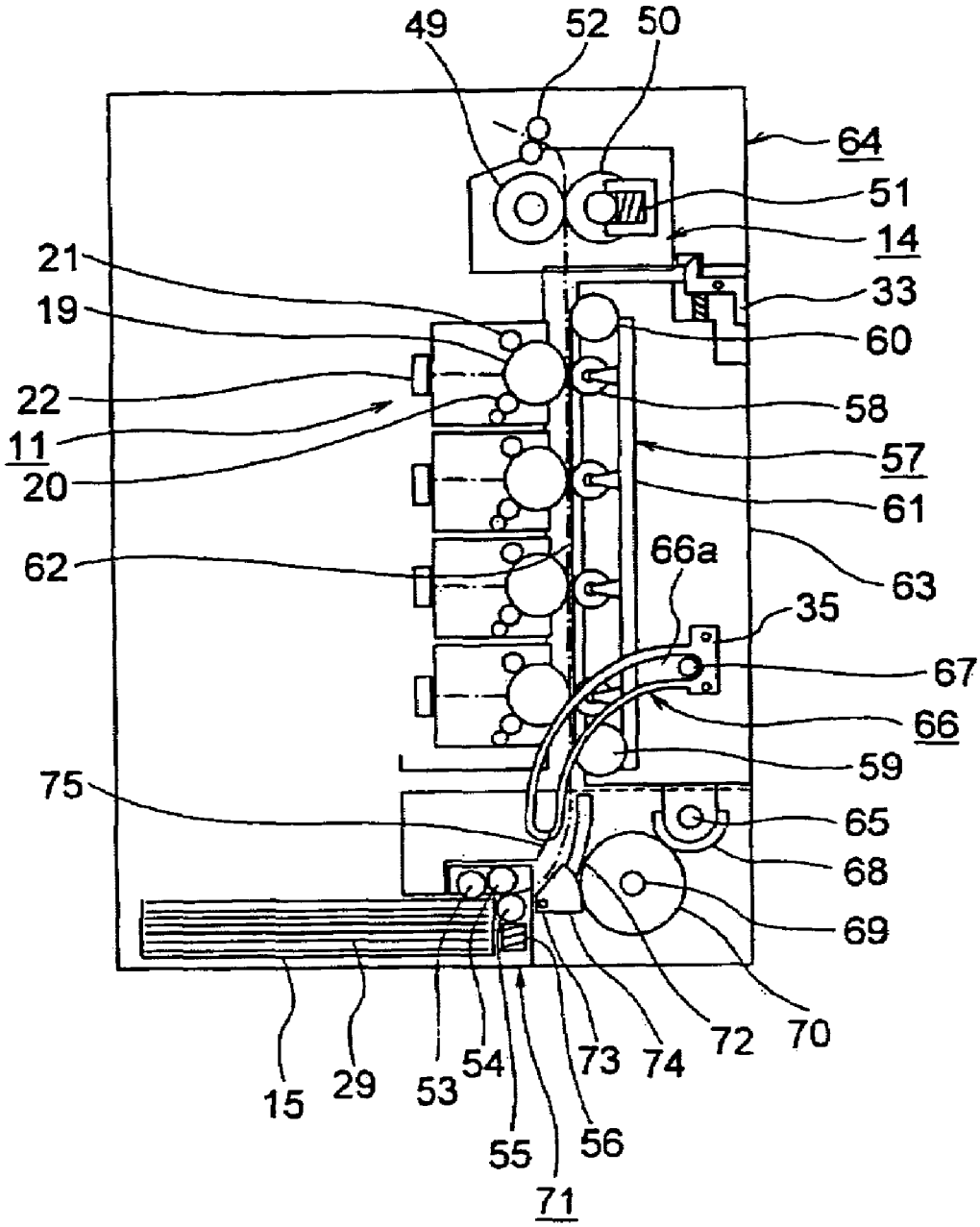
FIG. 6 is a schematic view showing the first status of a printer according to the second embodiment of this invention.
Figure 7:
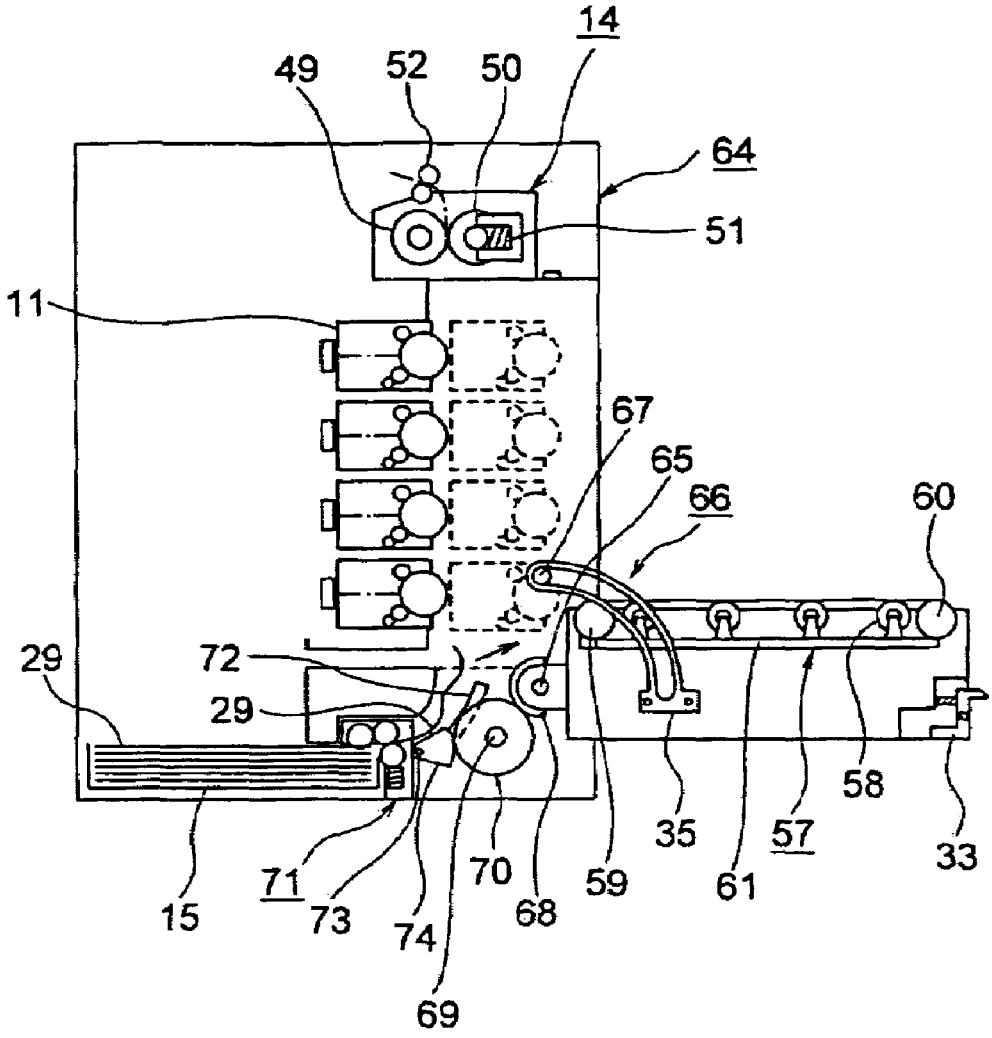
FIG. 7 is a schematic view showing the second status of the printer according to the second embodiment of this invention.

FIG. 6 is a schematic view showing the first status of a printer according to the second embodiment of this invention. FIG. 7 is a schematic view showing a second status of the printer according to the second embodiment of this invention.

As shown in drawings, the transfer unit 57 has four transfer rollers arrayed in a line from a lower side to an upper side in drawings as facing each of the photosensitive drums 19 serving as an image carrier of the image forming unit 11, a belt driving roller 59, a tension adding roller 60, a transfer belt 62 serving as an endless belt, and a transfer frame 61, in which the transfer belt 62 is formed as tensioned between the belt driving roller 59 and the tension adding roller 60 and sandwiched between each of the transfer rollers 58 and each of the photosensitive drums 19. Upon application of the bias voltage to each of the transfer rollers 58, the toner image defined as the developer image formed on the photosensitive drum 19 is transferred onto the paper 29 defined as the conveyed medium, thereby forming the multicolored toner image. The belt driving roller 59 is rotated upon driving the conveyance motor serving as a driving portion, not shown, and the transfer belt 62 is driven in a certain direction upon the rotation of the belt driving roller 59.

The tension adding roller 60 adds tension force to the transfer belt 62. The conveyance route for the paper 29 serving as the transfer member as well as the medium is formed between the transfer belt 62 and each of the photosensitive drums 19. The paper 29 is conveyed from a lower side to an upper side in the drawings along the conveyance route between the transfer belt 62 and each of the photosensitive drums 19 upon movement of the transfer belt 62 and rotation of each of the photosensitive drums 19.

Meanwhile, a holding frame 63 serving as the opening and closing member is supported in a pivotal manner with a shaft 65 disposed at a housing 64 as a pivotal center and placed at the closed position and the open position. Therefore, a coupling lever 66 in an arc shape serving as a coupling member is secured to the holding frame 63 with the screw 35, and a post 67 serving as a guided portion disposed at the housing 64 is inserted into an opening portion 66*a* in an arc shape serving as a guiding portion formed in a longitudinal direction of the coupling lever 34. A gear 68 mounted in a non-rotatable manner onto the shaft 65 secured to the holding frame 63 meshes with a gear 70 disposed rotatably with a shaft 69 of the housing 64.

The lever 33 is disposed in a pivotal manner at the holding frame 63 and the holding frame 31 can be locked in or released from the housing 64 upon operation of the lever 33. The transfer unit 57 is disposed in a detachable manner to the holding frame 63.

The fusing unit 14 is disposed on a downstream side of the transfer unit 57 in a paper 29 conveyance direction and the discharging roller 52 is disposed on a further downstream side than the fusing unit 14.

The feeding tray 15 serving as a medium container is defined as a tray mounted on a bottom portion of the housing 64 and contains the stacked papers 29. A feeding conveyance unit 71 serving as a medium supplying unit as well as a holding and nipping device is disposed at a front end (a right end in drawings) of the feeding tray 15 and has a pick-up roller 53 for picking up sheet by sheet the papers 29 contained in the feeding tray 15, a feeding roller 54 for feeding the picked-up paper 29 to the conveyance guide 72 serving as a medium conveyance member, a separating roller 55 disposed at a position facing the feeding roller 54, incorporating a torque limiter, and an urging member 56 for urging the separating roller 55 to the feeding roller 54.

The conveyance guide 72 is disposed as united with a gear 74 in a pivotal manner with a shaft 73 disposed at the housing 64 as a pivotal center, and the gears 74, 70 are meshed with each other. A conveyance guide 75 is disposed at a position facing the conveyance guide 72 and secured to the housing 64.

Operation of the printer thus structured is described next.

In this case, the printer makes printing operation in a state where the holding frame 63 is placed at the open position, as shown in FIG. 6.

The pick-up roller 53 in the feeding conveyance unit 71 is rotated to pick up sheet by sheet the papers 19 contained in the feeding tray 15 and furthermore, the paper 29 is, upon the rotation of the feeding roller 54, to the conveyance route between the transfer belt 62 and each of the photosensitive drums 19 through a gap between the conveyance guides 72, 75.

Upon the rotation of the belt driving roller 59, the transfer belt 62 is driven at the transfer unit 57 and each of the photosensitive drums 19 is rotated at the each of the image forming units 11, so that the paper 29 is conveyed. At each of the image forming units 11, the optical unit 22 forms the electrostatic latent images on the photosensitive drum 19 based on the image data and the developing device 20 develops the above electrostatic latent images to form the toner images. The toner images on the photosensitive drum 19 are transferred onto the paper 29 through electrically charging onto the transfer belt 62.

The paper 29 on which the toner images are transferred with each of the image forming units 11 is subsequently fed to the fusing unit 14 and heated and pressed between the heat roller 49 and the pressure roller 50. The paper 29 after completion of fusing the toner images is discharged to the exterior of the housing 64 with the discharging roller 52.

The operator makes the jamming process where the printing operation is suspended upon occurrence of the conveyance trouble on the conveyed paper 29. Furthermore, in a case of replacing the image forming unit 11, the intermediate transfer belt 62 of the transfer unit 57, or the like, the operator releases a lock between the lever 33 and the housing 64 by moving pivotally the lever 33 disposed at the holding frame 63 and places the holding frame 63 at the open position by moving pivotally the holding frame 63 in a clockwise direction around the shaft 32 as a center.

Consequently, the transfer belt 62 of the transfer unit 57 supported with the holding frame 63 is separated from each of the photosensitive drums 19. Furthermore, where the operator moves pivotally the holding frame 63 around the shaft 65 as a center up to a position at which the image-forming unit can be replaced, the post 67 is brought in contact with the end portion of the opening portion 66*a* of the coupling lever 66, thereby suspending the pivotal movement operation. Furthermore, since the gear 68 mounted in a non-independently rotatable manner onto the holding frame 63 is rotated in association with the pivotal movement of the holding frame 63, in a clockwise direction around the shaft 65 as a center together with the holding frame 31, the gear 70 in mesh with the gear 68 is rotated in a counterclockwise direction with the shaft 69 as a center.

The conveyance guide 72 is also pivotally moved in a clockwise direction around the shaft 73 as a center since the gear 74 in mesh with the gear 70 is rotated upon the rotation of the gear 70, with the shaft 73 as a center.

Therefore, where pivotally moving the holding frame 63 up to a position at which the image-forming unit 11 can be replaced, as described above, the conveyance route between the conveyance guides 72, 75 is made open in association with the pivotal movement of the holding frame 63. Consequently, upon pivotal movement of the holding frame 63 up to a position at which the image-forming unit 11 can be replaced, not only can the image-forming unit 11, the intermediate transfer belt 62 of the transfer unit 57, or the like be replaced, but also the conveyance route between the conveyance guides 72, 75 is made open, so that the paper 29 on the conveyance route can be easily removed even in the event of the conveyance trouble on the conveyed paper 29.

The gear 70 in mesh with the gear 68 is rotated in clockwise direction with the shaft 69 as a center since the gear 68 mounted to the holding frame 63 is rotated in a counterclockwise direction with the shaft 65 as a center where the holding frame 63 is pivotally moved from the open position to the closed position after the operator removes the paper 29 or replaces the image-forming unit 11, the transfer belt 62 of the transfer unit 57, or the like. Furthermore, the conveyance guide 72 is pivotally moved around the shaft 73 as a center in a counterclockwise direction since the gear 74 is rotated with the shaft 73 as a center upon the rotation of the gear 70. As a result, the conveyance route for the paper 29 is formed again between the conveyance guides 72, 75.

As described above, in this embodiment, the operator can replace the image-forming unit 11, the transfer belt 62 of the transfer unit 57, or the like since the transfer belt 62 and each of the photosensitive drums 19 are separated from each other upon pivotal movement of the holding frame 63 up to a position at which the image forming unit 11 can be replaced, and furthermore, the operator can easily remove the paper 29 causing the conveyance trouble in the conveyance route since the conveyance route between the conveyance guides 72, 75 can be open in association with pivotal movement of the holding frame 63.

Furthermore, the gear 70 of the housing 64 can be rotated in association with rotation of the gear 68 of the holding frame 63 at a time of rotating the holding frame 63, so that the operation for separating the transfer belt 62 and each of the photosensitive drums 19 from each other can be made simply in association with the operation for opening the conveyance route between the conveyance guides 72, 75.

Meanwhile, each of the image forming units 11 is secured to the housing 64 to move pivotally the transfer unit 57 including the transfer belt 57 in this embodiment but conversely, the transfer unit 57 including the transfer belt 62 can be secured to the housing 64 to move pivotally the image forming unit 11. Substantially the same effect as described above can be also obtained in this case upon opening the conveyance route between the conveyance guides 72, 75 in association with pivotal movement of the image forming unit 11.

The third embodiment will be described next. It is to be noted that substantially the same structures as those in the first embodiment are assigned with the same reference number as in the first embodiment, and for the sake of simplicity, those duplicated descriptions are omitted. Furthermore, the effect of the invention resulted from substantially the same structures is quoted from the effect in the first embodiment.

Figure 8:
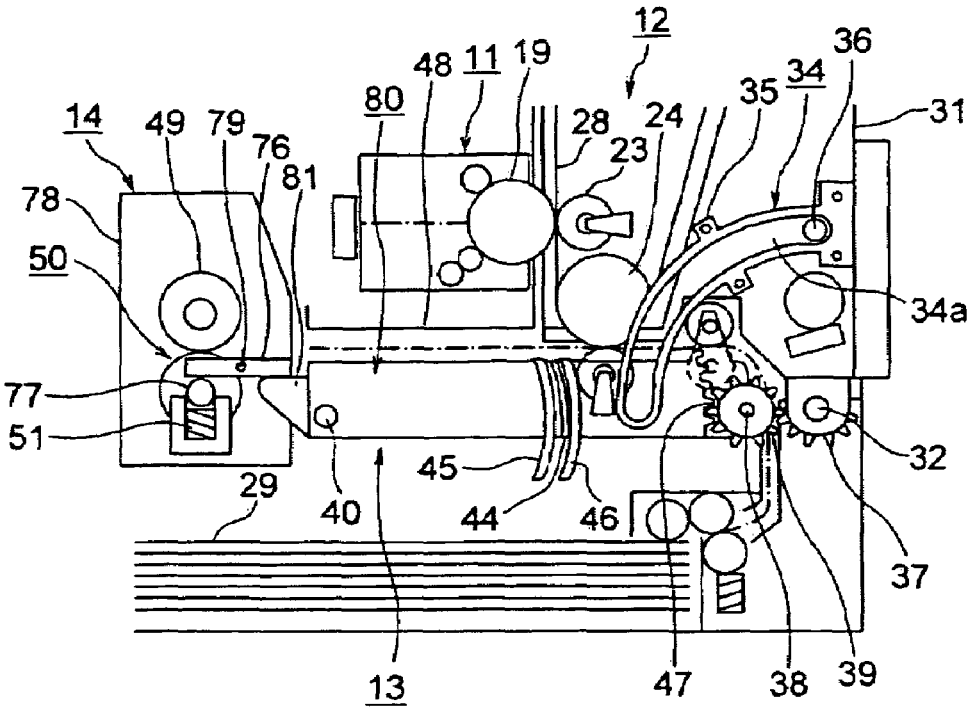
FIG. 8 is an enlarged view showing the first status of an essential part of a printer according to a third embodiment of this invention.
Figure 9:
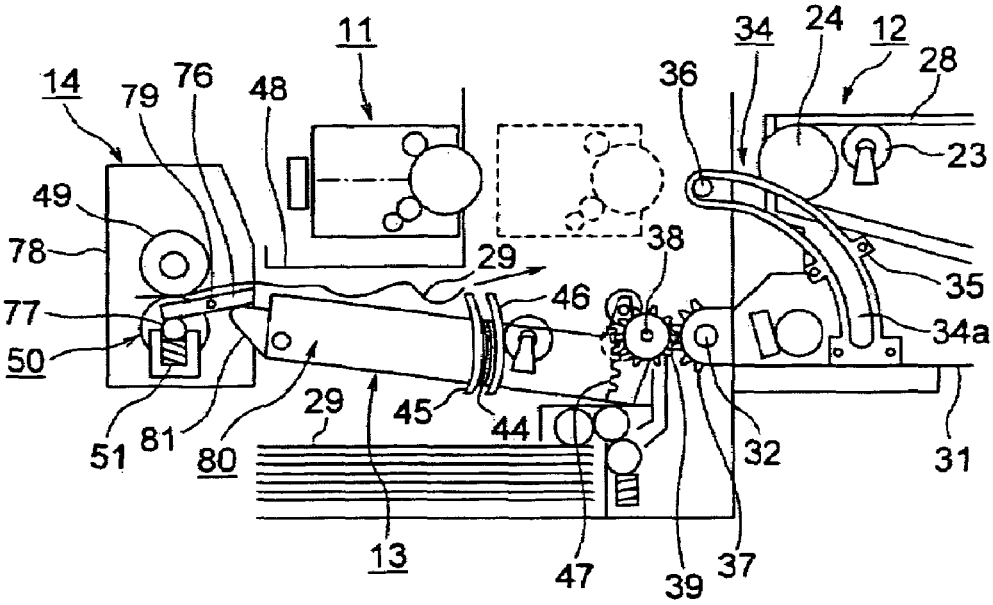
FIG. 9 is an enlarged view showing the second status of the essential part of the printer according to the third embodiment of this invention.

FIG. 8 is an enlarged view showing the first status of an essential part of a printer according to a third embodiment of this invention. FIG. 9 is an enlarged view showing the second status of the essential part of the printer according to the third embodiment of this invention.

As shown in drawings, the fusing unit 14 has the heat roller 49 serving as the first roller, the pressure roller 50 serving as the second roller, a cover 78, the urging member 51, and an urging releasing member 76. The urging member 51 urges the shaft 77 of the pressure roller 50 toward the heat roller 49 to push the pressure roller 50 to the heat roller 49. The urging releasing member 76 is disposed in a pivotal manner with a post 79 disposed at the cover 78 as a pivotal center, and has one end in contact with an end portion of a shaft of the pressure roller 50 and the other end in contact with a lever portion 81 serving as an engaging portion of a conveyance frame 80 serving as a medium conveyance member. Therefore, the heat roller 49 and the pressure roller 50 can be separated from each other upon pivotally moving the urging releasing member 76 in a counterclockwise direction.

Meanwhile, FIG. 9 shows a state where the holding frame 31 serving as the opening and closing member is placed at the open position and where the conveyance route between the conveyance guide 48 and the conveyance frame 80, for the paper 29 serving as the transfer member as well as the medium is rendered open and further, where the heat roller 49 and the pressure roller 50 are separated from each other.

Operation of the printer thus structured is described next.

First, the intermediate transfer belt 28 of the transfer unit 12 supported with the holding frame 31 and each of the photosensitive drums 19 serving as an image carrier is separated upon pivotal movement of the holding frame 31. Furthermore, where pivotally moving the holding frame 31 up to a position at which the image forming apparatus 11 can be replaced, the medium conveyance unit 13 is pivotally moved around the shaft 40 as a center in a clockwise direction upon the rotation of the gears 37, 39, 47, thereby making the conveyance route between the conveyance frame 80 and the conveyance guide 48 open.

At a time of pivotal movement of the conveyance frame 80, a lever portion 81 of the conveyance frame 80 pushes up one end of the urging releasing member 76 to move pivotally the urging releasing member 76 in a counterclockwise direction so the other end of the urging releasing member 76 as to push down the end portion of the shaft of the pressure roller 50 and as a result, the pressure roller 50 is separated from the heat roller 49 as a result, thereby releasing the paper 29 from being pressed.

In this embodiment, as described above, not only can the image-forming unit 11, the intermediate transfer belt 28 of the transfer unit 12, or the like be replaced but also the heat roller 49 and the pressure roller 50 can be separated from each other in association with the opening of the conveyance route between the conveyance frame 80 and the conveyance guide 48 since the operator moves pivotally the holding frame 31 up to a position at which the image forming unit 11 can be replaced, so that paper 29 on the conveyance route, held as nipped between the heat roller 49 and the pressure roller 50 can be easily removed.

The conveyance frame 80 is pivotally moved in a counterclockwise direction upon the rotation of the gears 37, 39, 47 where the operator moves pivotally the holding frame 31 from an open position up to a closed position after removing the paper 29 or replacing the image-forming unit 11, the intermediate transfer belt 28 of the transfer unit 12, or the like. As a result, the urging releasing member 76 can be freely moved pivotally in clockwise direction, and thus the pressure roller 50 is moved up upon urging force with the urging member 51, thereby being pushed to the heat roller 49.

In this embodiment, as described above, the paper 29 on the conveyance route, nipped between the heat roller 49 and the pressure roller 50 can be easily removed by situating the urging releasing member 76 in a manner separating the heat roller 49 and the pressure roller 50 from each other in association with the opening the conveyance route between the conveyance frame 80 and the conveyance guide 48.

The fourth embodiment will be described next. It is to be noted that substantially the same structures as those in the third embodiment are assigned with the same reference number as in the third embodiment, and for the sake of simplicity, those duplicated descriptions are omitted. Furthermore, the effect of the invention resulted from substantially the same structures is quoted from the effect in the third embodiment.

Figure 10:
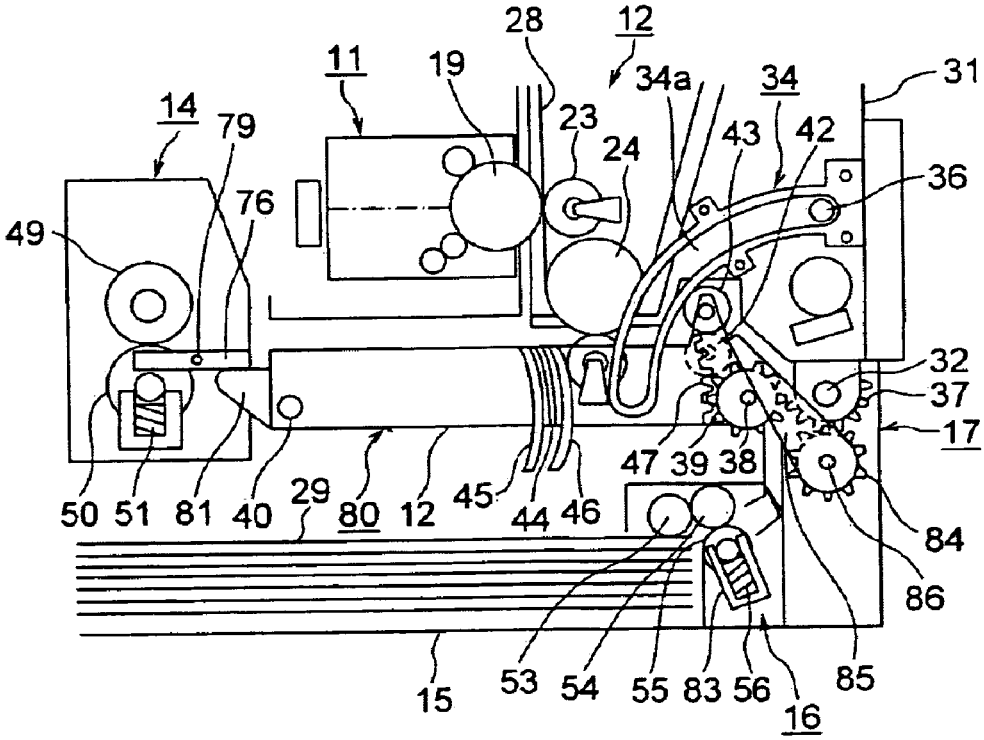
FIG. 10 is an enlarged view showing the first status of an essential part of a printer according to a fourth embodiment of this invention.
Figure 11:
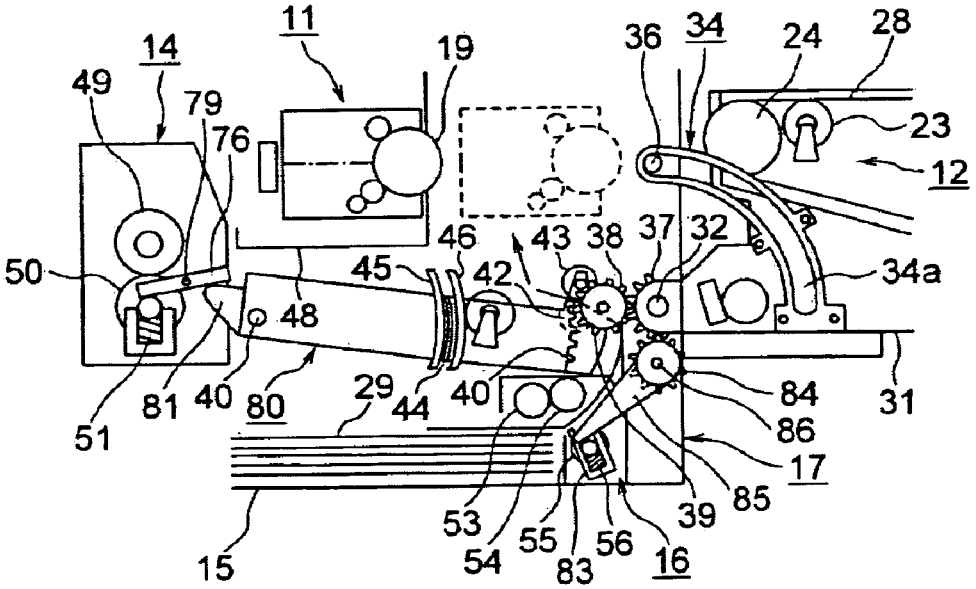
FIG. 11 is an enlarged view showing the second status of the essential part of the printer according to the fourth embodiment of this invention.

FIG. 10 is an enlarged view showing the first status of an essential part of a printer according to a fourth embodiment of this invention. FIG. 11 is an enlarged view showing the second status of the essential part of the printer according to the fourth embodiment of this invention.

In this case, the feeding conveyance unit 16 serving as a medium supplying unit as well as a nipping and holding device has the pick-up roller 53 disposed at the front end (a right side in drawings) of the feeding tray 15 serving as the medium container, for feeding sheet by sheet the paper 29 serving as a transfer member as well as a medium contained in the feeding tray 15, the feeding roller 54 serving as a first roller for feeding the picked-up paper 29 to the conveyance roller 42, the separating roller 55 serving as a second roller disposed at a position facing the feeding roller 54, incorporating a torque limiter, and the urging member 56 for urging the separating roller 55 toward the feeding roller 54. The separating roller 55 is guided with the guiding member 83 and supported in a freely movable manner in a direction of contacting with and separating from the feeding roller 54. Furthermore, the gear 37 mounted in a non-rotatable manner onto the shaft 32 secured to the holding frame 31 serving as the opening and closing member meshes with the gear 39 disposed rotatably with the shaft 38 of the housing 17 as a center and with the gear 84 disposed rotatably with the shaft 86 of the housing 17 as a center. An urging releasing lever 85 serving as an urging releasing member mounted onto the gear 84 can be moved pivotally with the shaft 86 as a center.

Meanwhile, FIG. 11 shows a state where the holding frame 31 is placed at an open position and where the conveyance route between the conveyance guide 48 and the conveyance frame 80, for the paper 29 is rendered open and where the heat roller 49 serving as a first roller and the pressure roller 50 serving as a second roller are separated from each other and where the feeding roller 54 and the separating roller 55 are separated from each other.

Operation of the printer thus structured is described next.

First, the intermediate transfer belt 28 of the transfer unit 12 supported with the holding frame 31 and each of the photosensitive drums 19 serving as an image carrier are separated from each other upon the rotation of the holding frame 31. Furthermore, where pivotally moving the holding frame 31 up to a position at which the image forming apparatus 11 can be replaced, the medium conveyance unit 13 is pivotally moved around the shaft 40 as a center in clockwise direction upon the rotation of the gears 37, 39, 47, thereby opening the conveyance route between the conveyance frame 80 and the conveyance guide 48.

At a time of pivotal movement of the conveyance frame 80, the lever portion 81 of the conveyance frame 80 pushes up one end of the urging releasing member 76 to move pivotally the urging releasing member 76 in a counterclockwise direction so the other end of the urging releasing member 76 as to push down the end portion of the shaft of the pressure roller 50 and as a result, the pressure roller 50 is separated from the heat roller 49, thereby releasing the paper 29 from being pressed.

The urging releasing lever 85 is pivotally moved in a counterclockwise direction around the shaft 86 as a center upon the rotation of the gears 37, 84 so the urging releasing lever 85 as to push up the end portion of the end of the separating roller 55 and as a result, the separating roller 55 is separated from the feeding roller 54, thereby releasing the paper 29 from being pressed.

In this embodiment, as described above, not only can the image-forming unit 11, the intermediate transfer belt 28 of the transfer unit 12, or the like be replaced but also the feeding roller 54 and the separating roller 55 can be separated from each other in association with the opening of the conveyance route between the conveyance frame 80 and the conveyance guide 48 since the operator moves pivotally the holding frame 31 up to a position at which the image forming unit 11 can be replaced, so that paper 29 on the conveyance route, held as nipped between the feeding roller 54 and the separating roller 55 can be easily removed.

Furthermore, the conveyance frame 80 is pivotally moved in a counterclockwise direction upon the rotation of the gears 37, 39, 37 where the operator pivotally moves the holding frame 31 from an open position to a closed position after removing the paper 29 or replacing the image forming unit 11, the intermediate transfer belt 28 of the transfer unit 12, or the like. As a result, the urging releasing member 76 is freely moved pivotally in a clockwise direction, so that the pressure roller 50 is moved upward upon reception of urging force from the urging member 56, thereby being pushed again to the feeding roller 49. Furthermore, the gear 84 is rotated in a clockwise direction in association with the rotation of the gear 37, so that the separating roller 55 is moved in a left upper direction with the urging force from the urging member 56, thereby being pushed again to the feeding roller 54.

As described above, in this embodiment, the paper 29 on the conveyance route, nipped between the feeding roller 54 and the separating roller 55 can be easily removed by situating the urging releasing lever 85 in a manner separating the feeding roller 54 and the separating roller 55 from each other in association with the opening of the conveyance route between the conveyance frame 80 and the conveyance guide 48.

The fifth embodiment will be described next. It is to be noted that substantially the same structures as those in the first embodiment to fourth embodiment are assigned with the same reference number as in the first embodiment to the fourth embodiment, and for the sake of simplicity, those duplicated descriptions are omitted. Furthermore, the effect of the invention resulted from substantially the same structures is quoted from the effect in the first embodiment to the fourth embodiment.

Figure 12:
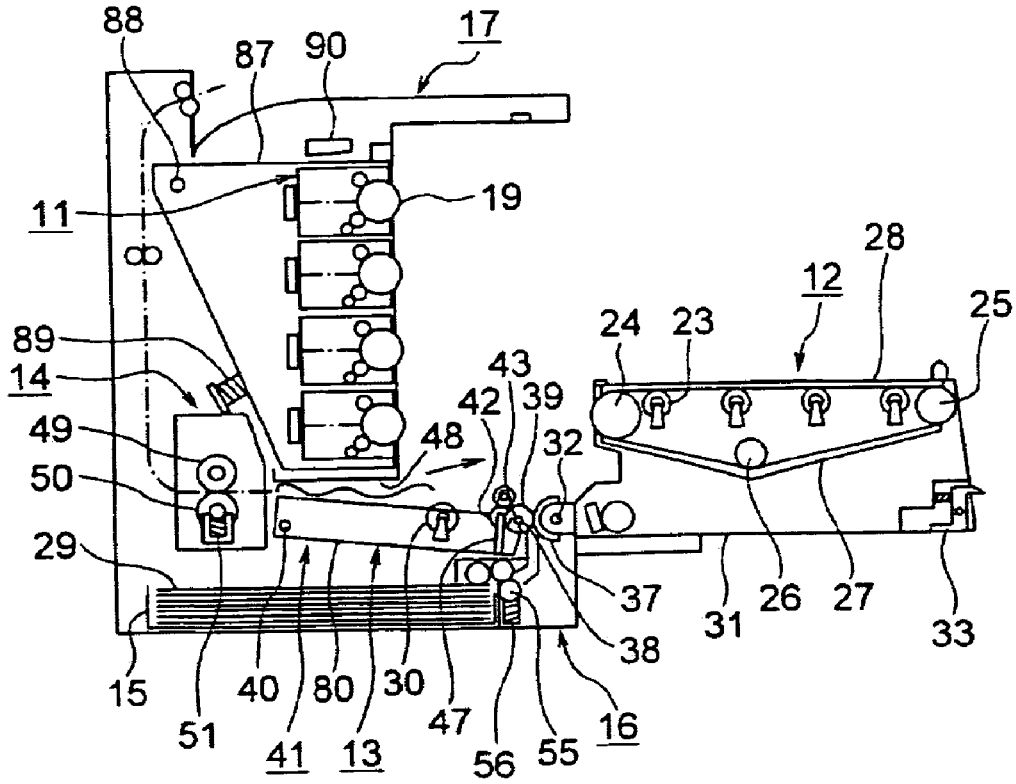
FIG. 12 is a schematic view showing the second status of a printer according to the fifth embodiment of this invention.
Figure 13:
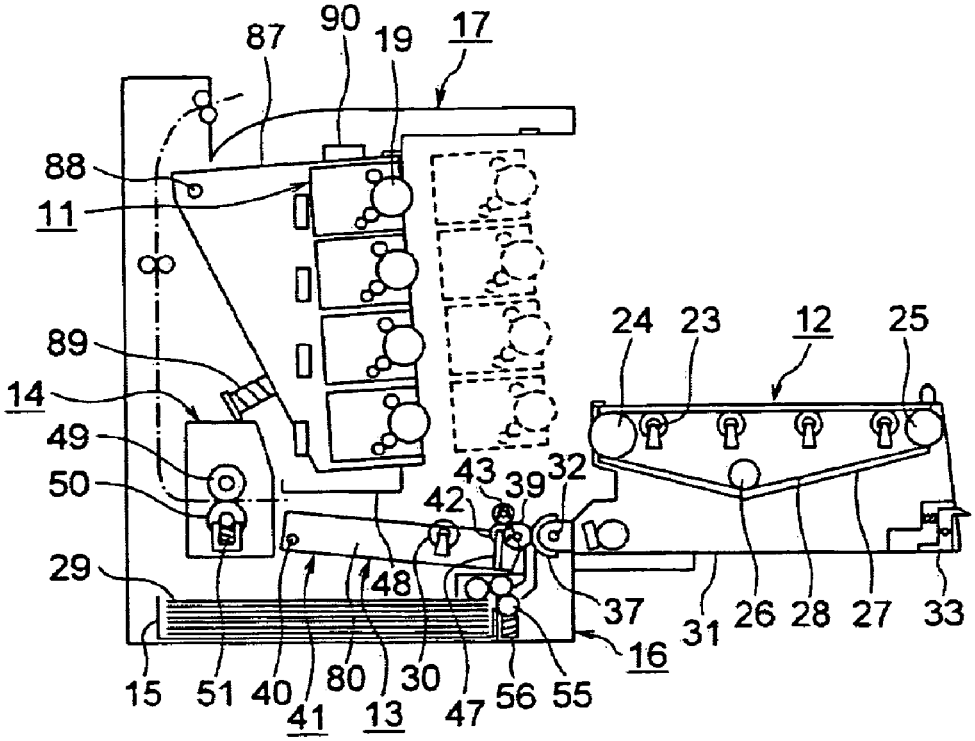
FIG. 13 is a schematic view showing the third status of the printer according to the fifth embodiment of this invention.

FIG. 12 is a schematic view showing the second status of a printer according to the fifth embodiment of this invention. FIG. 13 is a schematic view showing the third status of the printer according to the fifth embodiment of this invention.

As shown in drawings, an image forming unit 87 holds the image forming portion 11 and disposed in a pivotal manner with a shaft disposed at the housing 17 as a pivotal center. An urging member 89 urges the image forming unit 87 in a manner to move pivotally the image forming unit 87 in a counterclockwise direction, and the image forming unit 87 is secured to the housing 17 with a locking mechanism, not shown. Furthermore, a stopper 90 serving as a pivotal movement restricting member is disposed at the housing 17 in a manner not to pivotally move the image forming unit 87 at more than a certain degree angle.

Operation of the printer thus structured is described next.

The intermediate transfer belt 28 of the transfer unit 12 supported with the holding frame 31 and each of the photosensitive drums 19 are separated from each other upon the rotation of the holding frame 31 serving as the opening and closing member. Furthermore, the medium conveyance unit 13 is pivotally moved in clockwise direction around the shaft 40 as a center upon the rotation of the gears 37, 39, 47 where pivotally moving the holding frame 31 up to a position at which the image forming portion 11 can be replaced, and thus the conveyance route between the conveyance frame 80 and the conveyance guide 48 is rendered open.

At this point, the image forming portion 11, the intermediate transfer belt 28 of the transfer unit 12 can be replaced or the paper 29 between the conveyance frame 41 and the conveyance guide 48 serving as the medium conveyance member can be removed, but the image forming unit 87 is pivotally moved around the shaft 88 as a center upon reception of the urging force from the urging member 89 and comes in contact with the stopper 90 at a position at which the image forming unit 87 is pivotally moved at a certain degree angle, thereby being stopped where the operator releases the image forming unit 87 from the housing 17 upon operating the lock mechanism.

The operator moves the image forming unit 87 pivotally in clockwise direction to secure the image forming unit 87 to the housing 17 in using the lock mechanism after removing the paper 29 or replacing the image forming portion 11, the intermediate transfer belt 28 of the transfer unit 12, or the like.

Subsequently, the conveyance frame 80 is pivotally moved in a counterclockwise direction upon the rotation of the gears 37, 39, 47 where the holding frame 31 is pivotally moved from an open position to a closed position.

In this embodiment, as described above, the image forming unit 11 can be replaced more easily upon disposing in a pivotal manner the image forming unit 87 capable of holding the image forming portion 11.

The sixth embodiment will be described next. It is to be noted that substantially the same structures as those in the first embodiment to fifth embodiment are assigned with the same reference number as in the first embodiment to the fifth embodiment, and for the sake of simplicity, those duplicated descriptions are omitted. Furthermore, the effect of the invention resulted from substantially the same structures is quoted from the effect in the first embodiment to the fifth embodiment.

Figure 14:
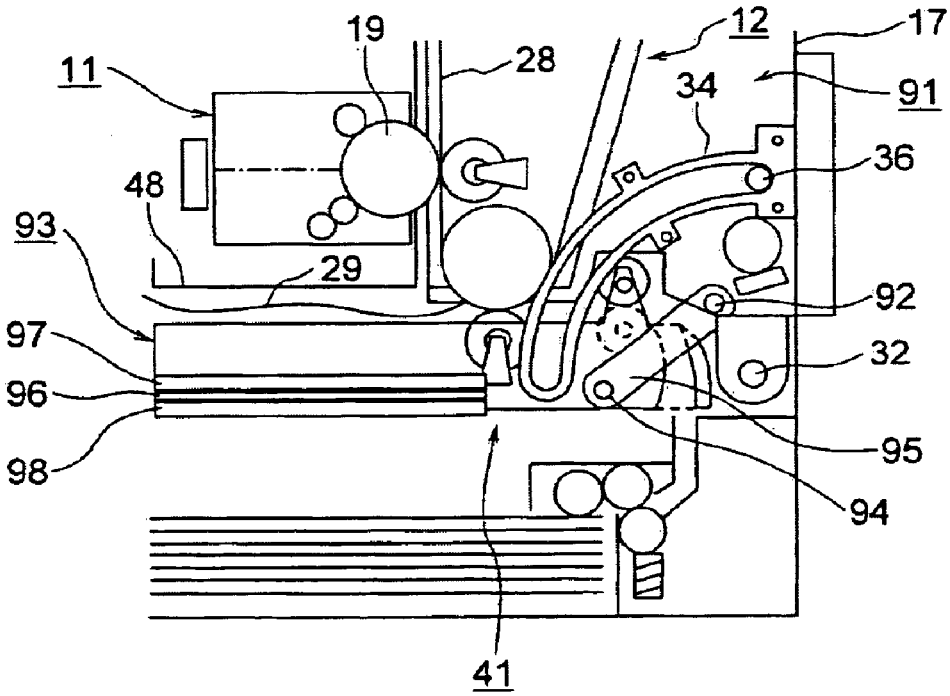
FIG. 14 is an enlarged view showing the first status of an essential part of a printer according to a sixth embodiment of this invention.
Figure 15:
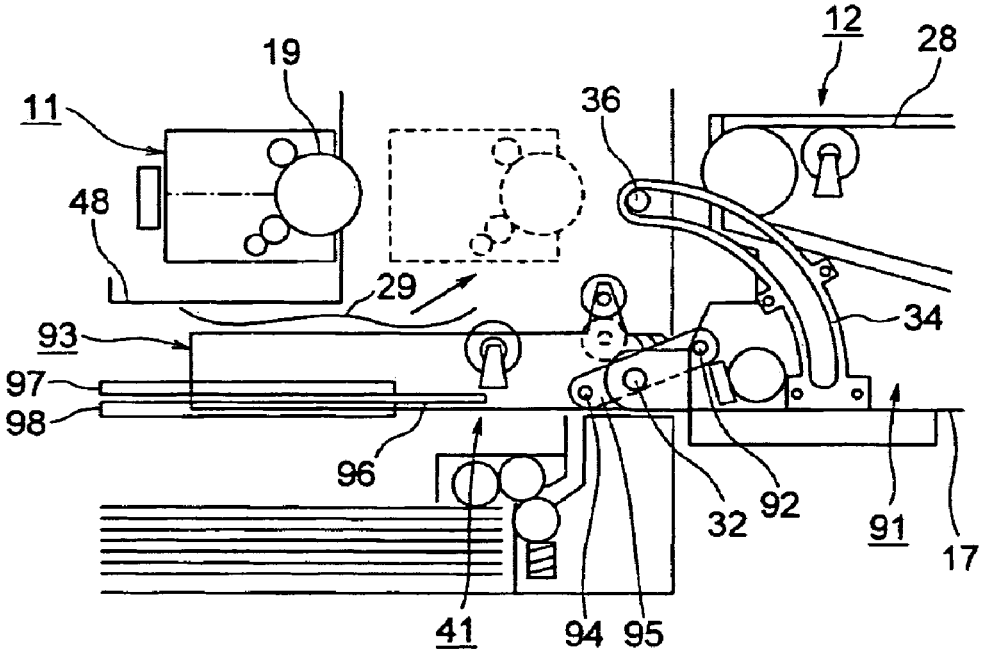
FIG. 15 is an enlarged view showing the second status of an essential part of a printer according to the sixth embodiment of this invention.

FIG. 14 is an enlarged view showing a first status of an essential part of a printer according to a sixth embodiment of this invention. FIG. 15 is an enlarged view showing a second status of an essential part of a printer according to the sixth embodiment of this invention.

As shown in drawings, a holding frame 91 serving as the opening and closing member has a post 92 whereas a conveyance frame 93 serving as a medium conveyance member has a post 94. The holding frame 91 and the conveyance frame 93 are coupled with a coupling lever 95 upon disposing the coupling lever 95 serving as a coupling member between the posts 92, 94. The conveyance frame 93 is movably disposed in a horizontal direction below the conveyance guide 48 with a certain interval, and moved ahead in association with pivotal movements of the holding frame 91. Therefore, a guide 96 is disposed in a horizontally extending manner at a side surface of the conveyance frame 93 and nipped between a pair of guides 97, 98 disposed in a horizontally extending manner at the housing 17.

Operation of the printer thus structured is described next.

The intermediate transfer belt 28 of the transfer unit 12 supported with the holding frame 91 and each of the photosensitive drums 19 serving as an image carrier are separated from each other upon the rotation of the holding frame 91. Where the holding frame 91 is pivotally moved around the shaft 32 as a center, the post 92 is pivotally moved around the post 94 as a center, so that the coupling lever 95 is moved forward and accordingly, the conveyance frame 93 is moved ahead. Therefore, the paper 29 on the conveyance frame 93 is moved ahead together with the conveyance frame 93, thereby being able to exchange the image forming portion 11, the intermediate transfer belt 28 of the transfer unit 12, or the like and to remove the paper 29 between the conveyance frame 41 and the conveyance guide 48.

As described above, in this embodiment, since the operator moves pivotally the holding frame 91 up to a position at which the image forming portion 11 can be replaced, the intermediate belt 28 and each of the photosensitive drums 19 are separated, thereby being able to replace the image forming portion 11, the intermediate transfer belt 28 of the transfer belt 12, or the like and further, the conveyance frame 93 is moved ahead in association with the rotation of the holding frame 91 to open the conveyance route between the conveyance frame 41 and the conveyance guide 48, thereby being able to remove easily the paper 29 jammed in the conveyance route.

Further modification can be applied to the printer described in the above embodiments.

Figure 16:
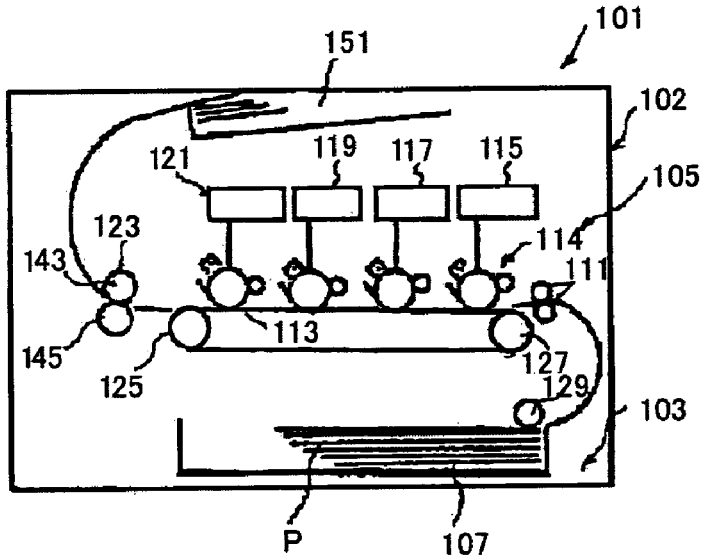
FIG. 16 is a view for illustrating a conveyance route of printing papers.

FIG. 16 illustrates a conveyance route of printing papers.

The papers contained in a paper tray 107 is picked up by a pick-up roller 109 sheet by sheet. The picked-up paper is conveyed up to a register roller 111, and is prevented from moving obliquely by hitting a front end of the paper on the register roller 111. Conveyance of the paper is thereafter started with the register roller 111, and the toner images are formed on the paper by each of image forming units 114 while the paper passes through the paper conveyance route formed between a conveyance belt and each of the image forming units 114. The paper on which the toner images are formed is conveyed up to a fusing unit 123 to fuse the toner images on the paper by the fusing unit 123. The paper on which fusing of toner images is completed is then delivered to an ejected paper stacker 151.

Figure 17:
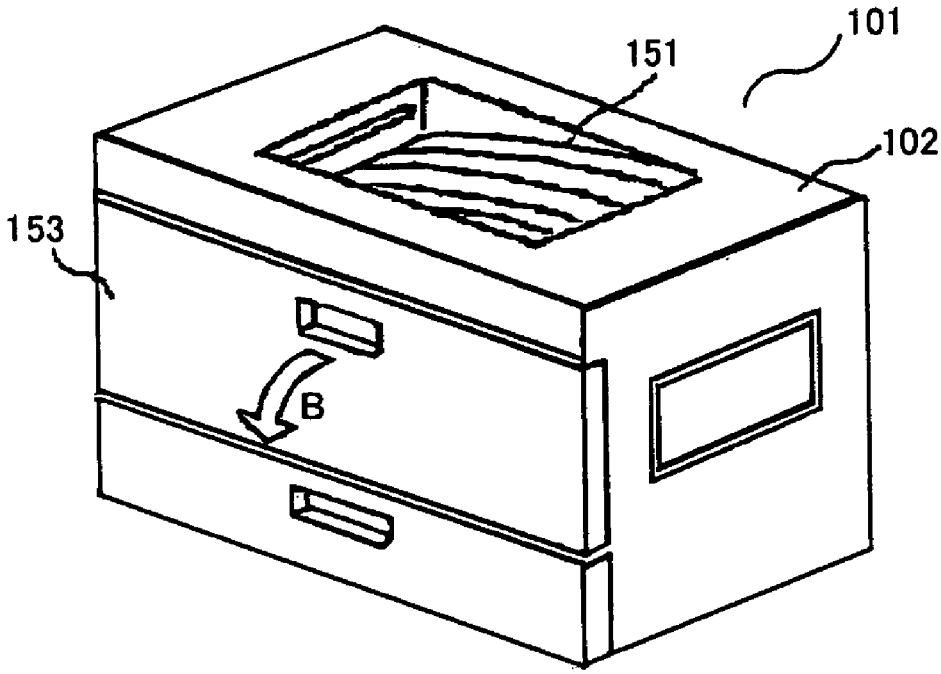
FIG. 17 is a schematic view showing an apparatus having an apparatus cover at a side surface.

FIG. 17 is a schematic view showing an apparatus having an apparatus cover at a side surface thereof.

Figure 18:
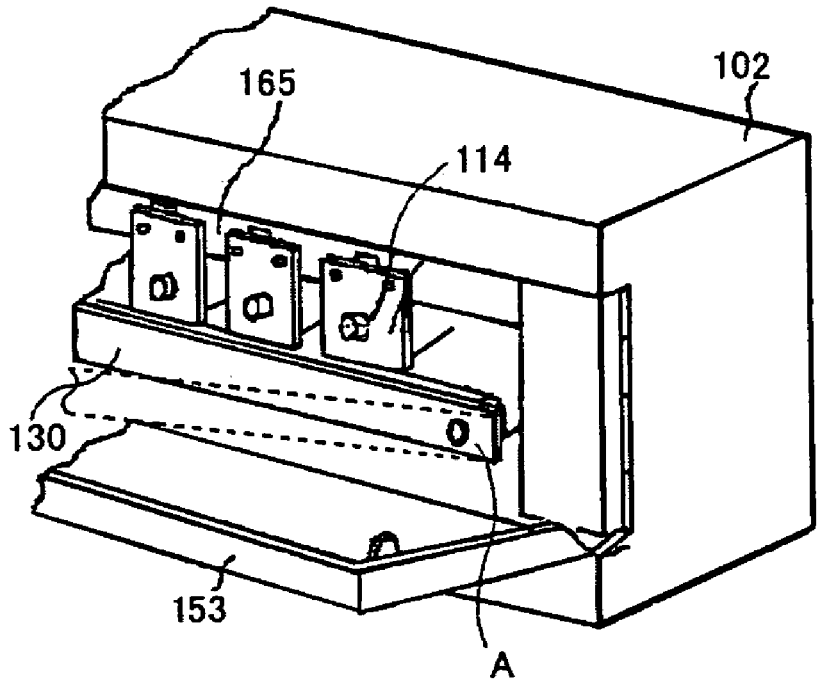
FIG. 18 is a view showing a status that the apparatus cover is made open.

FIG. 18 is a view showing a status that the apparatus cover is made open. By opening an apparatus cover 153, a conveyance belt unit 130 is pivotally moved in association with this open movement, around a point A as a center up to a position shown with a dashed line. Thus, the paper conveyance route formed between each of the image forming units 114 and the conveyance belt unit 130 can be made open.

It is to be noted that this invention is not limited to the above described embodiments but can be variously modified based on the purpose of this invention, and those modifications are not excluded from the scope of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image forming apparatus comprising:

an image forming portion disposed in a detachable manner;

an opening and closing member taking a closed position and an open position;

a transfer unit disposed at said opening and closing member, as facing said image forming portion, having a belt disposed in a freely drivable manner and transferring a developer image; and a medium conveyance member forming a conveyance route for conveying a medium, said medium conveyance member opening said conveyance route in association with movement of said opening and closing member from said closed position to said open position.

2. The image forming apparatus according to claim 1, wherein said belt is defined as an intermediate transfer belt and wherein said developer image is transferred onto said intermediate transfer belt and then transferred onto said medium.

3. The image forming apparatus according to claim 1, wherein said medium conveyed on said conveyance route is fed to said belt and further conveyed in association with driving of said belt.

4. The image forming apparatus according to claim 1, further comprising a nipping device having a first roller, a second roller, and an urging member for urging said second roller toward said first roller to nip said medium, and an urging releasing member for releasing urging force with said urging member in association with opening of said conveyance route in using said medium conveyance member.

5. The image forming apparatus according to claim 4, wherein said nipping device is defined as a fusing unit.

6. The image forming apparatus according to claim 4, wherein said nipping device is defined as a feeding conveyance unit.

7. The image forming apparatus according to claim 1, wherein said medium conveyance member is moved pivotally to render said conveyance route open.

8. The image forming apparatus according to claim 1, wherein said medium conveyance member is moved ahead to render said conveyance route open.

9. The image forming apparatus according to claim 1, wherein said image forming portion is supported with image forming unit disposed in a pivotal manner.

10. An image forming apparatus comprising:

an image forming portion disposed in a detachable manner;

an opening and closing member taking a closed position and an open position;

a transfer unit disposed as facing said image forming portion, having a belt disposed in a freely drivable manner and transferring a developer image; and a medium conveyance member forming a conveyance route for conveying a medium between said image forming portion and said transfer unit, said medium conveyance member opening said conveyance route in association with movement of said opening and closing member from said closed position to said open position.

11. The image forming apparatus according to claim 10, wherein said transfer unit is disposed at said opening and closing member.

12. The image forming apparatus according to claim 10, wherein said transfer unit is pivotally moved around a pivotal center as a center.

13. The image forming apparatus according to claim 10, wherein said image forming portion is composed of a plurality of image forming sections.

14. The image forming apparatus according to claim 10, wherein the image forming portion is a photosensitive member, wherein a toner image is formed on the photosensitive member in use, and wherein the toner image is transferred directly from the photosensitive member to paper in use as the paper is conveyed between said image forming portion and said transfer unit.

* * * * *